United States Patent [19]

Bridgewater

[11] Patent Number: 4,993,870

[45] Date of Patent: Feb. 19, 1991

[54] ANCHORING MEANS FOR BENTHIC BARRIER

[75] Inventor: Todd J. Bridgewater, Saginaw County, Mich.

[73] Assignee: Dow Corning Corporation, Midland, Mich.

[21] Appl. No.: 408,845

[22] Filed: Sep. 18, 1989

[51] Int. Cl.[5] ..... E02B 3/06

[52] U.S. Cl. ..... 405/21; 405/24; 405/15; 52/155; 52/166; 52/163

[58] Field of Search ..... 52/163, 166; 405/24, 405/21, 16, 259; 411/340, 344, 345, 341, 346, 512

[56] References Cited

U.S. PATENT DOCUMENTS

| | | | |
|---|---|---|---|
| 1,026,616 | 5/1912 | Stratton . | |
| 1,047,097 | 12/1912 | MacNab | 52/163 |
| 2,712,864 | 7/1955 | Clevett, Jr. | 52/163 |
| 2,892,518 | 6/1959 | Fiske | 52/163 |
| 3,186,047 | 6/1965 | Schwester et al. . | |
| 3,888,057 | 6/1975 | Zubke | 52/163 |
| 3,969,854 | 7/1976 | Deike . | |
| 4,044,513 | 8/1977 | Deike . | |
| 4,518,280 | 5/1985 | Fletcher . | |

*Primary Examiner*—David A. Scherbel
*Assistant Examiner*—Linda Jean Hoffert
*Attorney, Agent, or Firm*—Allan O. Maki

[57] ABSTRACT

A fixation device for securing articles such as benthic barriers to the earth comprising an elongated subteraneanly pivotable plastic body having a strap affixed centrally to one side thereof, and a benthic barrier clamping element with an aperture therethrough that is slidable on the strap. The strap is intended for passage through a hole in a benthic barrier, and the clamping element in ratchet-like fashion secures the benthic barrier to the ground or lake bottom to a desired degree of tightness.

9 Claims, 2 Drawing Sheets

ANCHORING MEANS FOR BENTHIC BARRIER

BACKGROUND

The present invention relates generally to an anchoring means for attaching articles such as benthic barriers, ground covers, tarps, etc.. to the earth.

Benthic barriers have heretofore been used to cover the bottom of a body of water to prevent the growth of aquatic weeds in the water. The present invention provides novel anchoring means for securing such barriers to the bottom of a body of water. The invention may be employed also to secure ground cover, tarps or barriers over inclines along highways, railways etc. to prevent erosion or landslides.

It has been known to apply barriers such as plastic film or woven or non-woven fabric to the bottom of a body of water. See application Ser. No. 07/197,781 to Bridgewater et al. said patent also teaches the use of stakes to secure the barrier to the body of water. Similar benthic barriers are disclosed in U.S. Pat. No. 4,518,280, issued to E. L. Fletcher on May 21, 1985. Erosion control barriers which are affixed to an embankment with stakes have also hithertofore been used. See for example U.S. Pat. No. 1.026.616. issued to E. P. Stratton on May 14, 1912. Earth anchors utilizing an elongated member that pivots under the earth to provide firm anchoring have also been used heretofore. See U.S. Pat. Nos. 3,969,854 and 4,044,513 to Deike.

Self clinching straps have heretofore been used for strapping or bundling together a plurality of article, for example for storage or shipping. The use of such means for securing ground clothes or benthic barriers has not, however, been suggested. See, for example, U.S. Pat. No. 318,047 Schwester et al issued June 1, 1965.

The present invention provides a new and improved anchoring means which can be applied to any of the barriers disclosed in said prior art. The anchoring means of the present invention include an elongated subteraneanly pivotable element to the side of which is attached a flexible strap which is provided with means such as teeth or notches that coact to lock in position a locking element of the "self clinching" type that is slidable on said strap toward the pivotable element to securely hold down the benthic barrier. The anchoring means of the present invention are preferably constructed entirely out of non metallic materials in order to minimize hazards to people and wildlife.

SUMMARY OF THE INVENTION

The present invention relates to improved fixation means for securing articles such as benthic barriers for aquatic weed control or erosion control fabrics to the earth which means include an elongated subteraneanly pivotable body portion having a strap centrally affixed to a side thereof, a barrier clamping element slidable on the strap toward the pivotable element which element is provided with means for locking it in place thereby securely holding down a benthic barrier that is provided with holes for passage therethrough of such straps. The pivotable element, which is preferably formed of plastic is provided with a concentric bore so that the stake may be slipped over an insertion rod. The bore may either extend either partly or entirely through the length of the pivotable element. The strap is preferably formed with notches or ratchet-like projections that coact with a pawl-like element on the internal surface of an aperture extending through the clamping element to provide a one way fastener which can be repeatedly tightened but not loosened. Alternatively the aperture is provide with a sharp edged pawl-like means to lock the clamping element in a desired position on the strap.

The invention will be more specifically set forth in the detailed description and the accompanying drawings.

DRAWINGS

FIG. 1 is a perspective view with parts in cross-section view of an anchoring means of the present invention, FIG. 2 is a diagrammatic view illustrating underwater application of a benthic barrier with the anchoring means of this invention, FIG. 3 is a cross-sectional view of the subteraneanly pivotable element of a fixation means of this invention shown in conjunction with apparatus for installation thereof, FIG. 4 is a cross-sectional view of a further embodiment of the invention with parts broken away, and FIG. 5 is a fragmentary cross-sectional view of a further embodiment showing an alternate means for securing a strap to a pivotable unit.

DETAILED DESCRIPTION

Figure 1:
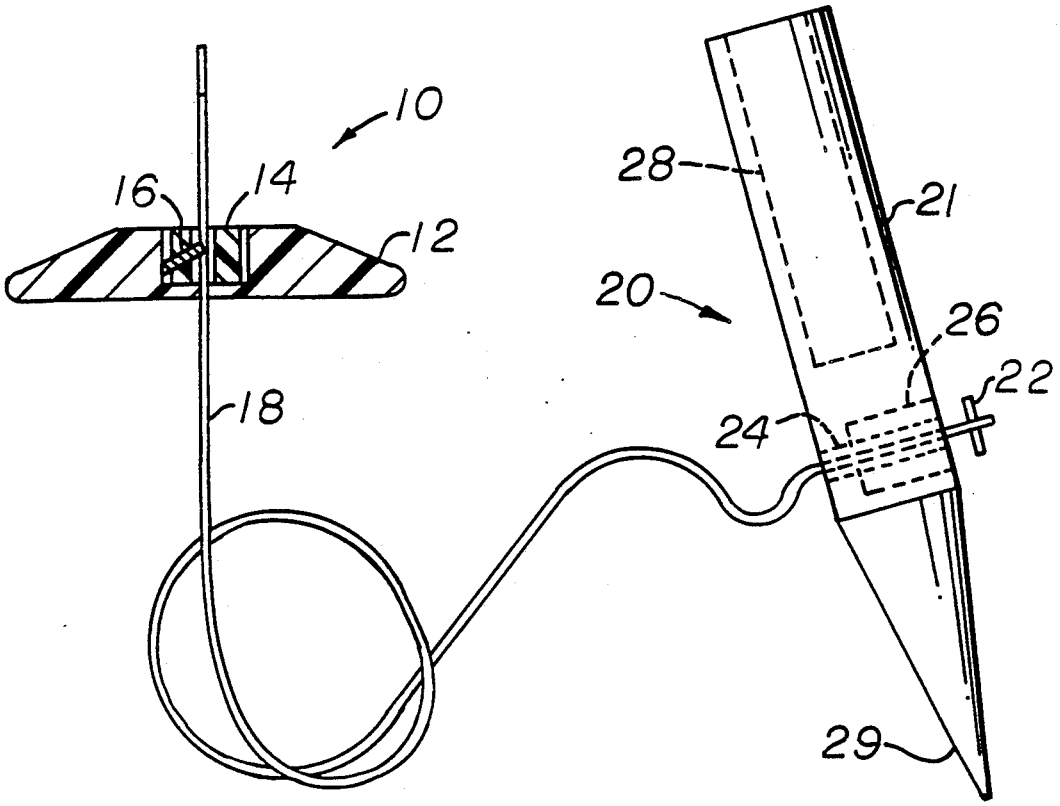

Referring firstly to FIG. 1, there is shown an anchoring means 10 of this invention which includes an elongated hollow tubular subteraneanly pivotable portion 20 to one side of which is affixed a strap 18 that is adapted to slidably receive clamping member 12 thereon. Member 12 is preferably is the shape of a disc of sufficient diameter to effectively hold down a benthic barrier 32. 5 to 7 cm in diameter has been found suitable.

Figure 2:
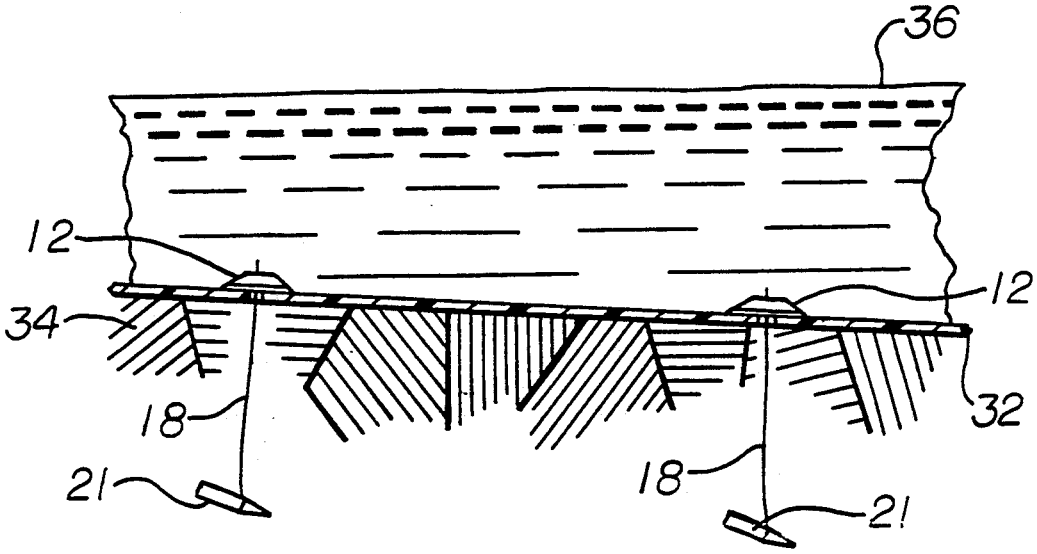

All parts of anchoring means 10 are preferably formed of tough plastic materials such as polypropylene, nylon or high density polyethylene. Strap 18 may be provided with rachet-like teeth that engage a pawl-like element 16 that is embedded in a central insert 14 in clamping element 12. Alternatively element 12 can be formed of one piece provided that it is formed of a similar material sufficiently hard and elastic to provide a pawl-like element 16 having sufficient strength to act as a locking means for member 12. If pawl like member 16 is formed of a sharpened piece of metal, it may not be necessary to form a rachet-like surface on strap 18 but rather to rely on the pawl-like element to dig into the strap 18 to effectively permit clamping element 12 to be moved down, but not up, strap 18 as viewed in FIGS. 1 and 2.

Subteraneanly pivotable element 20 is formed of an elongated body portion 21 which has a hollow central core 28, that is adapted to fit over an insertion rod 142, by means of which it may be driven into the ground. In the embodiment illustrated in FIG. 1, an opening 24 of a configuration to receive strap 18 is provided through the side of body portion 21 below the center point thereof. A pin 22, which can fit into a cavity 26 in body portion 21, may be used to secure strap 18 to body portion 21. A pointed insertion end 29 is preferably provided to permit easy insertion of element 20 into the ground. After insertion into the ground element 20/21 may subteraneanly pivot when upward force is applied to strap 18, if soil conditions permit. In soft sand, element 21 will tend to pivot to the position illustrated in FIG. 2. It will be appreciated that in the event benthic barrier 32 loosens from lake bottom 34, it can easily tightened again by sliding clamping element 12 further down on strap 18.

Figure 3:
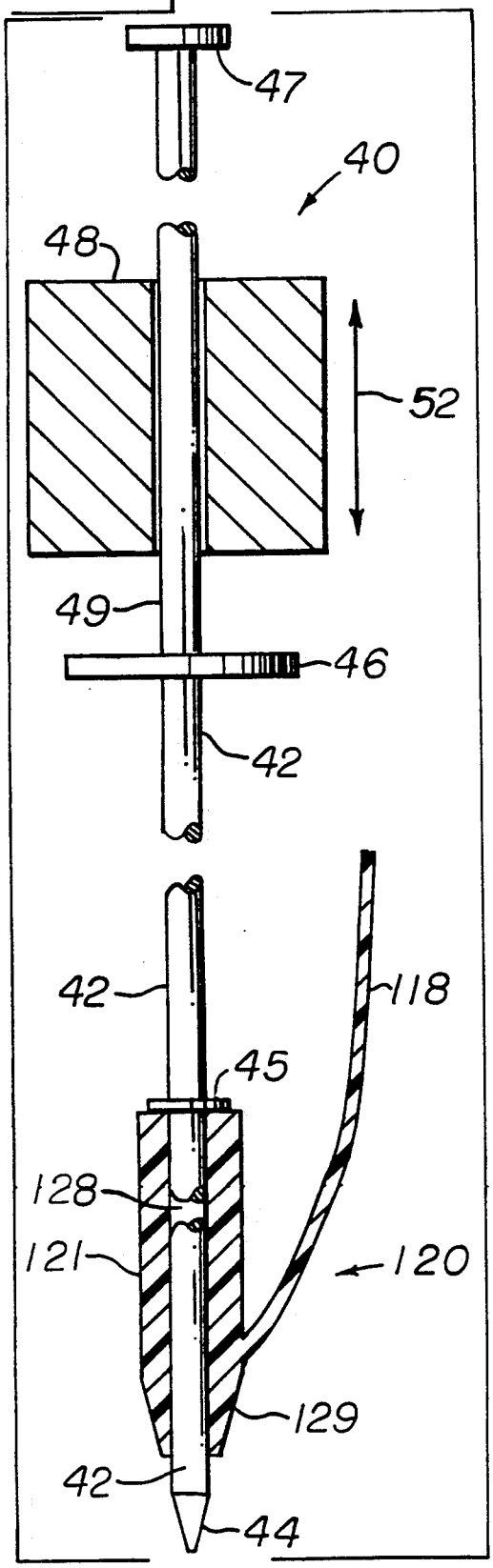
Figure 4:
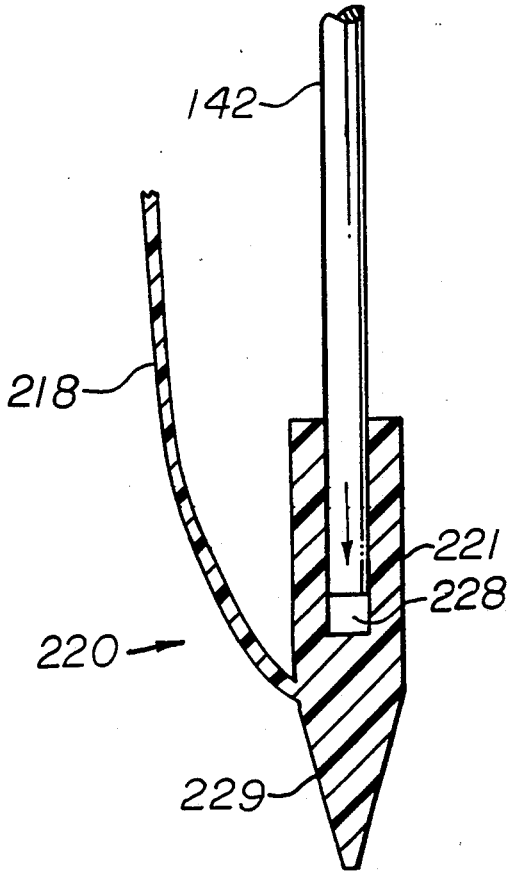

Insertion apparatus 40 as seen in FIG. 3 consists of an elongated rod portion 42 or 142 which is of a diameter such that hollow tubular core 28, 128 or 228 (depending on the particular embodiment used) can be slipped over the same. The lower end 44 of rod 42 is preferably tapered in the embodiment shown in FIG. 3 to facilitate insertion of the stake into the ground. In the embodiment shown in FIG. 4 installing rod 142 is provide with a blunt end as shown to fit against the bottom of hollow tubular core 228 of body portion 228. If desired, a shoulder such as 45 can be added to the embodiment of insertion rod 142 shown in FIG. 4. In the embodiment of FIG. 4, pivotable element 220 is molded of one piece with strap 218. In other respects the embodiment is similar to that shown in FIG. 1.

In the alternate embodiment of FIG. 3 strap 118 is preferably also molded integrally with body portion 121 of subteraneanly pivotable element 120. Hollow core 128 extends entirely through body portion 121 and is adapted to receive insertion rod 42. Rod 42 may have a pointed end 44 as shown for ease of insertion. Shoulder 45 is provided so that driving force applied to rod 42 is transmitted to body portion 121. Rod 42 is also provided with a shoulder 46 which is designed to be impacted by a hammering element 48 formed of metal such as steel and having a hollow central bore, which as shown, fits over upper portion 49 of rod 42. A cap 47 may be provided to retain hammering element 48 on rod end 49. Rod 42 may be of a length to accommodate ease underwater installation of the pivotable element, preferably 4 to 6 feet (1.2 to 2 meters). Benthic barrier 32 should be provided with holes to permit insertion of the body portion and strap therethrough.

Figure 5:
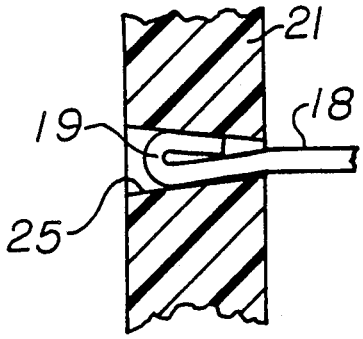

In FIG. 5 an alternative way to attach strap 18 to body portion 21 is shown. In this embodiment a tapered opening 25 is provided to receive a doubled over end 19 of strap 18, which end becomes wedged in opening 25 to affix the parts together. It has been found than a 14° angle between the opposed side of opening 25 provides optimum results.

It will be apparent that installation of a benthic barrier using the anchoring means of this invention is quite simple. The installing apparatus with pivotable in place as shown in FIG. 3 can be driven through a benthic barrier by puncturing the same in cases where the barrier is of a tear-resistant structure such as non-woven fabric. Otherwise, as noted, the barrier or fabric may be provided with holes and/or grommets for passage of the pivotably elements therethrough. Insertion of the stake into the ground is completed by applying sufficient pressure and/or blows by hammer element as indicated by arrow 52 to drive the pivotable element securely into the bottom of the body of water. The anchoring means can be similarly installed if it is desired to attach an article such as a fabric or tarp to the ground outside of a body of water.

It is to be understood that the foregoing embodiments are to be considered illustrative of the invention. Various modifications, changes or alterations of the invention disclosed herein may be evident to those skilled in the art and thus the invention disclosed herein is not intended to be limited by the description hereinabove but rather, is intended to be limited only by the appended claims.

That which is claimed is:

1. A fixation device for securing articles to the earth comprising an elongated subteraneanly pivotable body portion having a bore extending at least partly through the length thereof to receive an installing rod, said pivotable body having a strap affixed centrally to one side thereof, and a benthic barrier clamping element with an aperture therethrough that is slidable on the strap, the strap being intended for passage through a hole in a benthic barrier, the clamping element being provided with coacting means which in ratchet-like fashion allow the clamping means to slide on said strap toward but not away from said pivotable body, thereby providing means to secure a benthic barrier to the ground or a lake bottom to a desired degree of tightness.

2. A fixation device according to claim 1 in which said pivotable body and strap are formed of nylon.

3. A fixation device according to claim 1 wherein said pivotable body is hollow through its entire length.

4. A fixation device according to claim 1 wherein the pivotable body is tapered toward one end.

5. A fixation device according to claim 1 in combination with a benthic barrier wherein said barrier is positioned at the bottom of a body of water and said strap penetrates said barrier with the pivotable body embedded beneath said bottom and the clamping element overlies said barrier and acts to hold the same in place on the said bottom.

6. A fixation device for securing articles such as benthic barriers to the earth comprising an elongated subteraneanly pivotable plastic body having a strap affixed centrally to one side thereof at a point closer to its bottom end than its top, and a benthic barrier clamping element with an aperture therethrough that is slidable on the strap, the strap being intended for passage through a hole in a benthic barrier and having ratchet-like indentations along one side thereof, the clamping element being provide with pawl-like means which coact with said ratchet-like indentations to allow the clamping means to slide on said strap toward but not away from said pivotable body, thereby providing means to secure a benthic barrier to the ground or lake bottom to a desired degree of tightness.

7. A device according to claim 6 wherein said strap and said pivotable body are integrally molded of one piece.

8. A device according to claim 6 wherein said strap is affixed to said pivotable body by wedging of a doubled over end thereof in a tapered hole which passes through said body.

9. A device according to claim 8 wherein said pivotable body has a hollow central bore that extends partly through the length thereof, and tapered hole is located at a point below the closed end of said bore.

* * * * *